US007540048B2

(12) United States Patent
Piraino

(10) Patent No.: US 7,540,048 B2
(45) Date of Patent: Jun. 2, 2009

(54) ADJUSTABLE SUPPORT MEANS FOR A BED

(76) Inventor: Mario Cladinoro Piraino, 5 Nolan Close, East Doncaster, Victoria (AU) 3109

( * ) Notice: Subject to any disclaimer, the term of this patent is extended or adjusted under 35 U.S.C. 154(b) by 148 days.

(21) Appl. No.: 10/573,004

(22) PCT Filed: Sep. 26, 2003

(86) PCT No.: PCT/AU03/01274

§ 371 (c)(1),
(2), (4) Date: Mar. 19, 2007

(87) PCT Pub. No.: WO2005/030009

PCT Pub. Date: Apr. 7, 2005

(65) Prior Publication Data

US 2007/0214571 A1 Sep. 20, 2007

(51) Int. Cl.
*A61G 7/015* (2006.01)

(52) U.S. Cl. ..... 5/613; 5/617; 5/612

(58) Field of Classification Search ..... 5/612, 5/933, 934, 613, 617; 297/284.4, 284.8
See application file for complete search history.

(56) References Cited

U.S. PATENT DOCUMENTS

| | | | | |
|---|---|---|---|---|
| 853,049 A | | 5/1907 | Weston | |
| 1,914,661 A | | 6/1933 | Burke | |
| 3,126,554 A | * | 3/1964 | Janapol | 5/243 |
| 3,289,222 A | * | 12/1966 | Nielsen | 5/617 |
| 3,298,363 A | | 1/1967 | Parkin | |
| 3,339,214 A | | 9/1967 | Janapol | |

(Continued)

FOREIGN PATENT DOCUMENTS

| | | |
|---|---|---|
| CA | 2 146 706 | 10/1996 |

(Continued)

OTHER PUBLICATIONS

International Search Report issued Feb. 9, 2004 for PCT/AU2003/001274.

*Primary Examiner*—Michael Trettel
(74) *Attorney, Agent, or Firm*—Husch Blackwell Sanders Welsh & Katz

(57) ABSTRACT

A support base for a bed mattress having at least two planar portions with at least one rotatable planar portion able to rotate relative an adjacent planar portion with a planar flexible continuous mattress able to extend over both the rotatable planar portion and the adjacent planar portion, and the support base further including an adjustable support means at least partially mounted on the rotatable planar portion and selectively able to adjust a portion of the mattress resting on the rotatable planar portion out of the plane of extension of the adjacent remainder of the mattress wherein the support base allows for adjustment from a continuous linear formation to a backrest formation with the adjustable support means providing localized support. The support base further including a differential displacement member connected to the at least one rotatable planar portion, said differential displacement member engaging said adjustable support means so as to displace the adjustable support means towards the a portion of the mattress resting on the rotatable planar portion such that rotation of the at least one planar portion relative to said another causes adjustment of said portion of the mattress out of the plane of extension of the adjacent remainder of the mattress.

11 Claims, 11 Drawing Sheets

U.S. PATENT DOCUMENTS

| | | | | | |
|---|---|---|---|---|---|
| 3,340,548 | A | * | 9/1967 | Janapol | 5/243 |
| 3,484,878 | A | * | 12/1969 | Nielsen | 5/617 |
| 3,534,417 | A | | 10/1970 | Boyles | |
| 4,307,477 | A | * | 12/1981 | Jacobsen | 5/618 |
| 4,389,743 | A | | 6/1983 | Callaway | |
| 4,494,260 | A | | 1/1985 | Olds et al. | |
| 5,048,167 | A | | 9/1991 | Heffley et al. | |
| 5,109,558 | A | | 5/1992 | Di Blasi | |
| 5,136,740 | A | | 8/1992 | Kraft | |
| 5,708,996 | A | * | 1/1998 | Marenco | 5/613 |
| 6,061,856 | A | | 5/2000 | Hoffmann | |
| 6,088,853 | A | | 7/2000 | Jansen | |
| 6,874,182 | B2 | * | 4/2005 | L'Hegarat et al. | 5/612 |
| 7,159,255 | B2 | * | 1/2007 | Piraino | 5/238 |
| 2004/0098805 | A1 | * | 5/2004 | Piraino | 5/613 |

FOREIGN PATENT DOCUMENTS

| | | |
|---|---|---|
| CH | 659 180 | 1/1997 |
| DE | 4 442 719 | 12/1995 |
| DE | 1 970 0132 | 7/1998 |
| EP | 103 807 | 3/1984 |
| EP | 337 828 | 10/1989 |
| EP | 374 742 | 10/1994 |
| EP | 1 201 164 | 5/2002 |
| FR | 2 662 063 | 11/1991 |
| FR | 275 5358 | 5/1998 |
| GB | 211 7234 | 1/1985 |
| WO | WO01/70163 | 9/2001 |
| WO | WO02/15750 | 2/2002 |

* cited by examiner

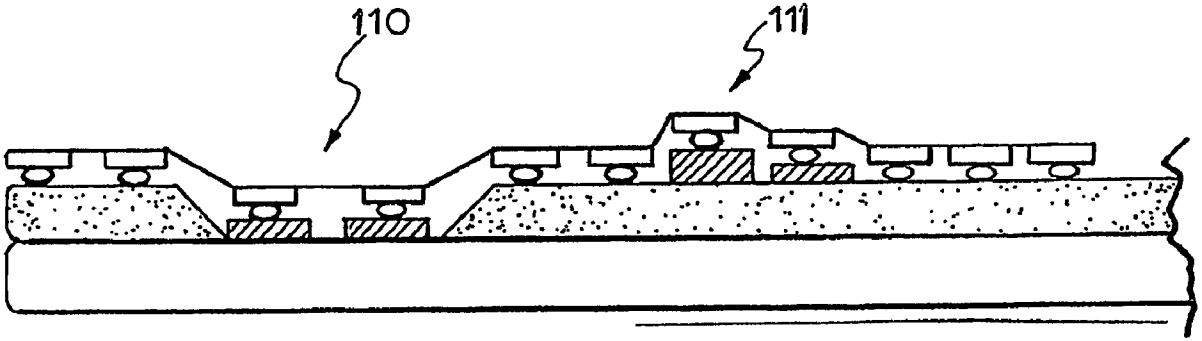
FIGURE 8A
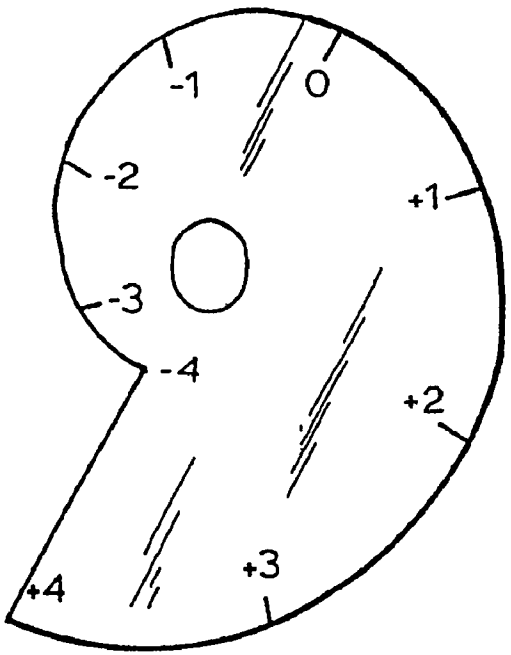
FIGURE 8B
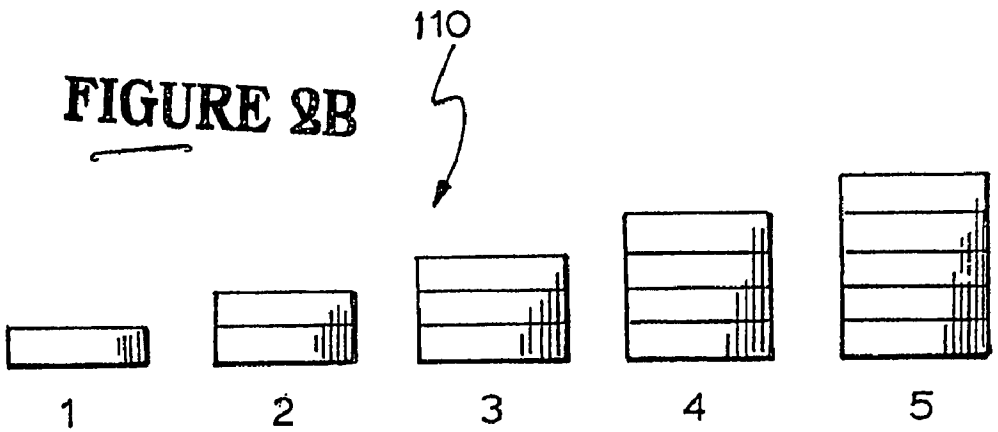

ADJUSTABLE SUPPORT MEANS FOR A BED

INTRODUCTION TO THE INVENTION

This invention relates to a bedding apparatus and in particular to an improved adjustable support means for a bed. More particularly the invention relates to an adjustable configuration of support for a bed which can have an inner sprung mattress or other type of mattress.

BACKGROUND TO THE INVENTION

A bed ensemble is a combination of an upper mattress supported on a lower base and forms a typical bedding apparatus in common use. The upper mattress can be of any type, composition or configuration to provide the necessary comfort and secondary support for the user. The lower base is used to elevate the mattress off the ground and to provide ventilation, but importantly to also provide controlled support for the upper mattress.

Since people have very distinctly unique body shapes and weight distribution along the length of their bodies, mattress and bed ensembles need some means of variable support along the length of the mattress. In particular the adjustment is required from the shoulder down to the waist, lower back, hip, under the knees and ultimately at the lower leg and feet.

However a prime importance is the correct support of a person in a bed particularly if a person is in bed for a long period such as in the case of incapacitated people or patients in hospitals. Although hospital beds have various moving parts these are primarily for use for facilitating medical operations or emergency positioning of the patient. The only variation for the comfort of the patient is the planar half folding of the bed to provide the top end of the bed as a back rest and allow the patient to sit up.

It is therefore an object of the invention to provide an improved support base for a bed that allows better support for the long term user of beds.

It is also an object of the invention to provide an improved support base for a bed that overcomes or at least ameliorates the problems of the beds of the prior art.

DESCRIPTION OF THE INVENTION

In accordance with the invention there is provided a support base for a bed mattress, the support base including an adjustable support means for selectively adjusting a portion of the mattress out of the plane of extension of the adjacent remainder of the mattress.

The adjustable support means can be able to selectively adjust a portion less than a quarter of the mattress. The adjustable support means can be positioned so as to adjust an end portion of the mattress to provide a headrest or footrest for the user of the bed. However in another form the adjustable support means can be positioned so as to adjust a middle portion of the mattress to provide a lower lumbar support or knee support for the user of the bed.

The adjustable support means is selectively operated by a powered means.

The adjustable support means is preferably operated in conjunction with a folding of the plane of the bed to provide a backrest such that the adjustable support means provides a localised support relative to the folding plane of the bed.

The adjustable support means is in one form operative in conjunction with powered operation of the folding bed. In another form the adjustable support means is operative in conjunction with mechanical operation of the folding bed.

The mechanical operation of the adjustable support means in conjunction with the folding bed can use levers, rods, plates, gussets and sliding mechanisms associated with the hinged folding of the bed to provide adjusting a portion of the mattress out of the plane of extension of the adjacent remainder of the mattress.

In another option the mechanical operation of the adjustable support means in conjunction with the folding bed uses cams associated with the hinged folding of the bed to provide adjusting a portion of the mattress out of the plane of extension of the adjacent remainder of the mattress. The cams can be rotational cams or linearly operative cams.

Also in accordance with the invention there is provided a support base for a bed mattress having at least two planar portions with at least one able to rotate relative one another, and the support base further including an adjustable support means able to adjust a portion of the mattress out of the plane of extension of the adjacent remainder of the mattress, and the support base still further including a differential displacement member connected with the at least two planar portions and the adjustable support means such that rotation of the at least one planar portion relative to said another causes adjustment of said portion of the mattress out of the plane of extension of the adjacent remainder of the mattress.

The adjustable support means can be able to selectively adjust a portion less than a quarter of the mattress. The adjustable support means can be positioned so as to adjust an end portion of the mattress to provide a headrest or footrest for the user of the bed. However in another form the adjustable support means can be positioned so as to adjust a middle portion of the mattress to provide a lower lumbar support or knee support for the user of the bed.

The adjustable support means is selectively operated by a powered means.

The adjustable support means is preferably operated in conjunction with a folding of the plane of the bed to provide a backrest such that the adjustable support means provides a localised support relative to the folding plane of the bed.

The adjustable support means is in one form operative in conjunction with powered operation of the folding bed. In another form the adjustable support means is operative in conjunction with mechanical operation of the folding bed.

The mechanical operation of the adjustable support means in conjunction with the folding bed can use levers associated with the hinged folding of the bed to provide adjusting a portion of the mattress out of the plane of extension of the adjacent remainder of the mattress.

In another option the mechanical operation of the adjustable support means in conjunction with the folding bed uses cams associated with the hinged folding of the bed to provide adjusting a portion of the mattress out of the plane of extension of the adjacent remainder of the mattress. The cams can be rotational cams or linearly operative cams.

The invention also provides a support base for a bed mattress which can have at least two planar portions with at least one rotatable planar portion able to rotate relative an adjacent planar portion with a planar flexible continuous mattress able to extend over both the rotatable planar portion and the adjacent planar portion, and the support base further including an adjustable support means at least partially mounted on the rotatable planar portion and selectively able to adjust a portion of the mattress resting on the rotatable planar portion out of the plane of extension of the adjacent remainder of the mattress wherein the support base allows for adjustment from a continuous linear formation to a backrest formation with the adjustable support means providing localised support.

The support base for a bed mattress can further include a differential displacement member connected to the at least one rotatable planar portion, said differential displacement member engaging said adjustable support means so as to displace the adjustable support means towards the a portion of the mattress resting on the rotatable planar portion such that rotation of the at least one planar portion relative to said another causes adjustment of said portion of the mattress out of the plane of extension of the adjacent remainder of the mattress.

The differential displacement member can be connected to the rotatable planar portion and engages a fixed means so as to displace the adjustable support means towards the a portion of the mattress resting on the rotatable planar portion such that rotation of the at least one planar portion relative to said another causes adjustment of said portion of the mattress out of the plane of extension of the adjacent remainder of the mattress.

The differential displacement member is in one form an elongated member connected to the rotatable planar portion and engaging a fixed means so as to extend at an differing angle to the rotating planar portion such that rotation of the rotating planar portion causes a differential movement of the differential displacement member to the rotating planar portion to displace the adjustable support means towards the a portion of the mattress resting on the rotatable planar portion such that rotation of the at least one planar portion relative to said another causes adjustment of said portion of the mattress out of the plane of extension of the adjacent remainder of the mattress.

The invention can have a support base for a bed mattress including a housing having a plurality of transverse slats for supporting said mattress wherein one or more of said slats are individually adjustable relative to said housing to provide calibrated positive or negative height adjustment for each slat, characterised in that said height adjustment is provided by a means which is operable external to said housing. The height adjustment means may be (a) cams positioned at either end of a given slat, (b) elongate cams supporting the length of each slat, (c) general height adjusting blocks, or (d) height adjusting blocks calibrated to a height adjustment scale shared by other means for height adjustment, such as cams. If the elongate cams are made of suitable diameter the slats can be eliminated with the bed mattress supported directly on the cams, which function as slats.

Accordingly, in another aspect the invention provides a support base for a bed mattress including a housing having a plurality of transverse elongate cams for supporting said mattress and an adjustment means for said cams wherein one or more of said cams are individually adjustable relative to said housing to provide height calibrated adjustment for said bed mattress.

Preferably said height adjustment means is provided by a means which is operable external to said housing.

The cams may be fixed to a common axle which protrudes outside the housing to provide the external access to said height adjustment means. The cams may also be provided with calibrations to provide quantitative data on the amount of adjustment occurring. Handles or other fittings may be used to operate the height adjustment means.

The adjustment can be either totally individual from one height adjustment means to the next, or may be coordinated between height adjustment means to provide rapid adjustment.

The height adjustment may also be achieved by "general" height adjusting blocks or may be faithfully duplicated by the use of height adjusting blocks corresponding to the cam calibrations.

The support base may be adapted for a range of bed sizes including single, double and larger sizes. The adjustment means can be coordinated for both sides of a multiple user bed or separate systems incorporated in either side.

In another aspect the invention provides a support base for a bed mattress wherein said support base housing has a hinged portion adapted for raising to support the user in a partially upright position wherein the raiseable portion of said housing incorporates one or more transverse slats or transverse elongate cams for supporting said mattress wherein the slats or cams are individually adjustable relative to said housing to provide local adjustment of said mattress wherein said adjustment is provided by a means which is operable external to said housing.

BRIEF DESCRIPTION OF THE DRAWINGS

In order that the invention will be more readily understood embodiments of the invention will be described by way of illustration only with reference to the drawings wherein:

FIG. 8*a* shows the positive and negative slat adjustment using height adjustment blocks.

FIG. 8*b* shows a calibrated cam and corresponding height blocks.

DETAILED DESCRIPTION OF THE INVENTION

Figure 1:
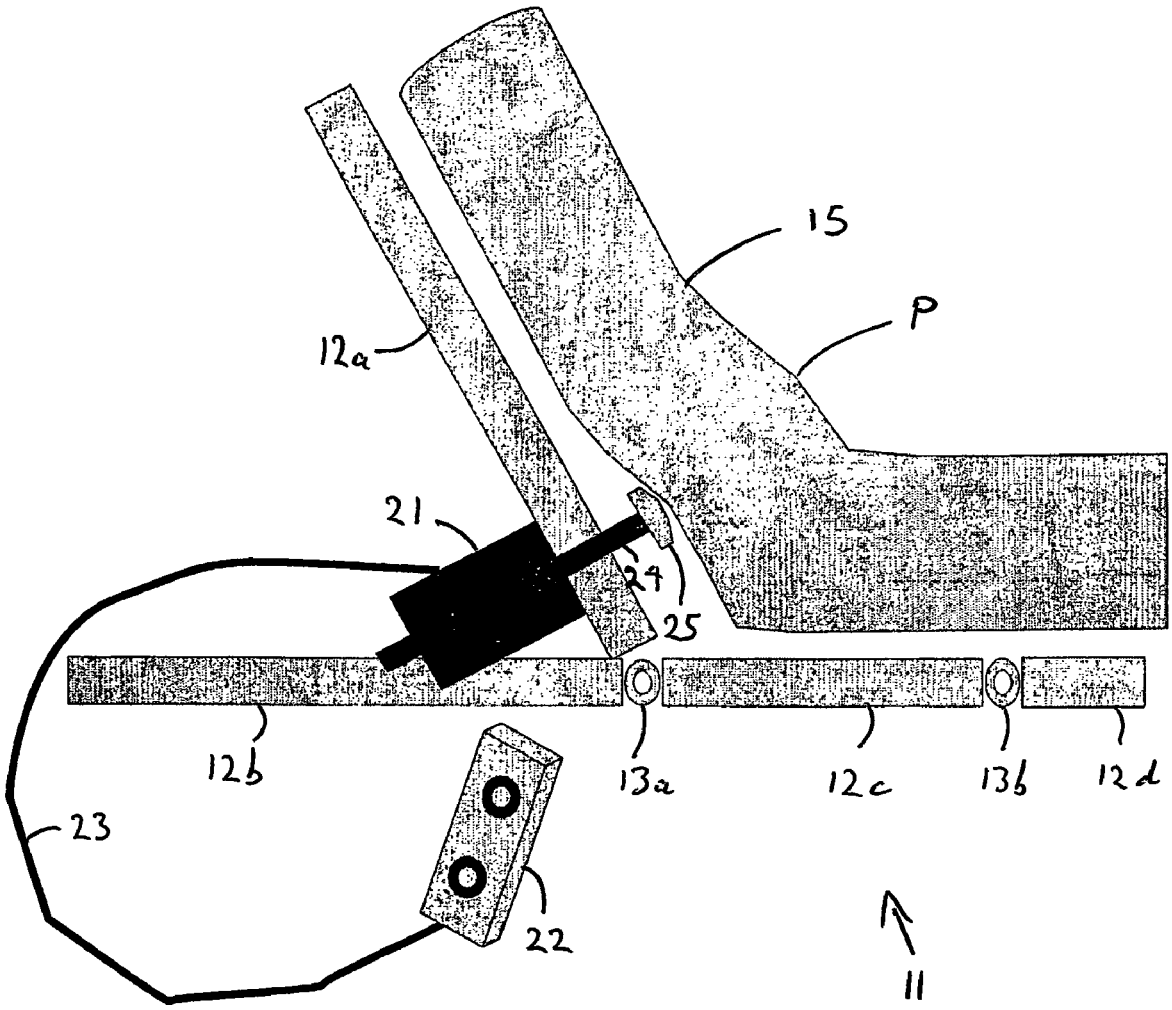
FIG. 1 is a diagrammatic cross sectional view of a support base for a bed and mattress in accordance with a first embodiment of the invention.
Figure 2:
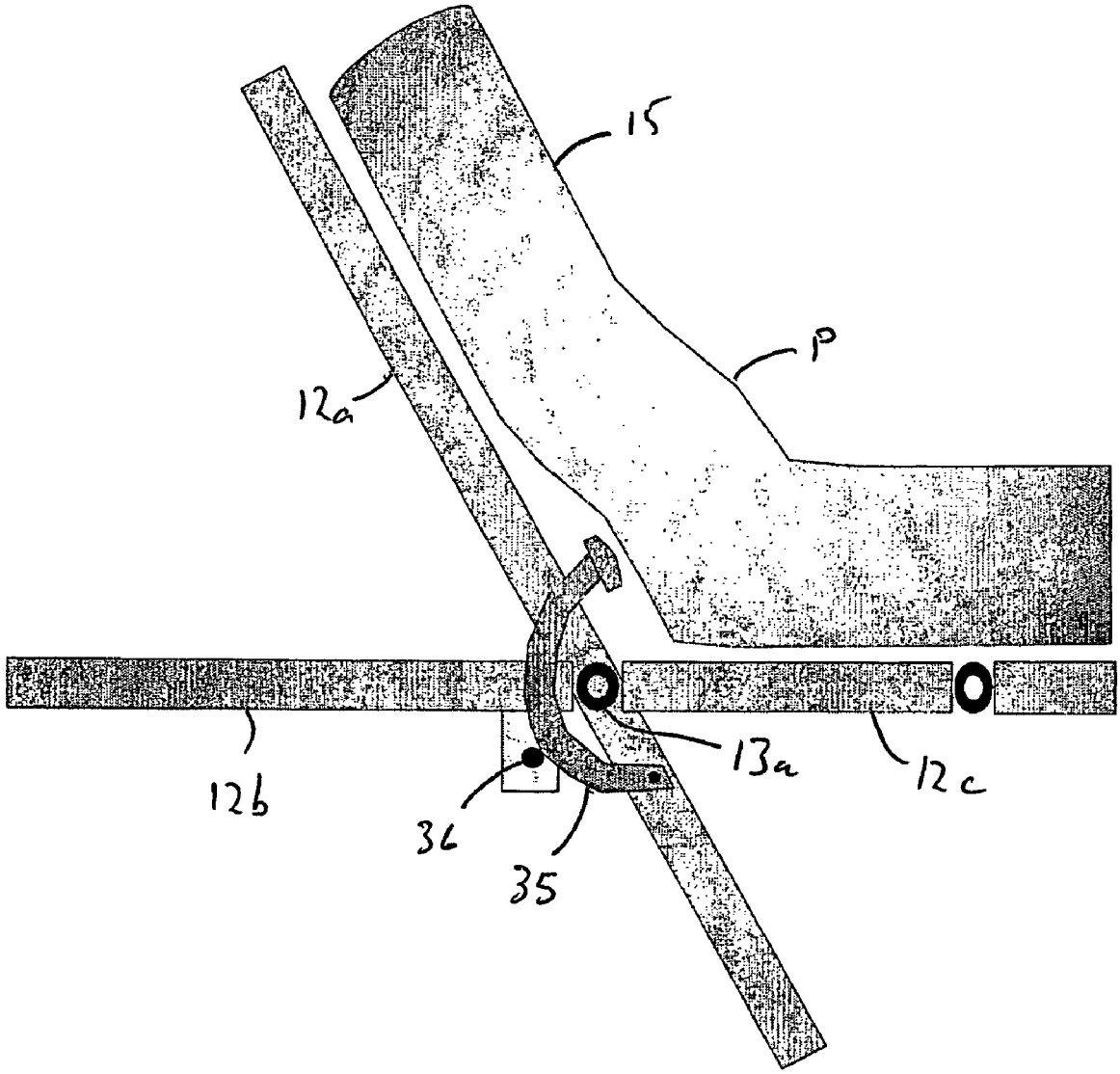
FIG. 2 is a diagrammatic cross sectional view of a support base for a bed and mattress in accordance with a second embodiment of the invention.

Referring to the drawings and particularly FIGS. 1 to 5 there are shown various embodiments of support base for a bed. The support base 11 supports a bed mattress 15 and has at least two planar portions 12*a*, 12*b*, 12*c* and 12*d*. One of the planar portions 12*a* is a rotatable planar portion able to rotate around a pivot 13*a* relative an adjacent planar portion 12*c*. In the disclosed position of FIG. 1 the rotatable planar portion

12*a* is rotated upwardly to form an inclined back rest for the occupant of the bed to allow the occupant to sit up. The mattress 15 being a planar flexible continuous mattress is able to extend over both the rotatable planar portion 12*a* and the adjacent planar portion 12*c*.

However in the sitting up position the mattress provides no lumbar support. Therefore in the embodiment of the invention shown in FIG. 1 there is the support base 11 further includes an adjustable support means 21 which is mounted on the rotatable planar portion 12*a*.

The adjustable support means 21 in FIG. 1 is an electric motor or magnetic field lift controlled by a controller 22 by wire 23. The electric motor or magnetic field lift 21 powers a piston 24 with a piston cap 25 into the rear of the mattress to provide a localised protrusion P of the mattress. The electric motor 21 pushes the piston like rod 24 up or down to increase or decrease support of the underside of the mattress using electronic controls connected by wire or remote to the motor. In the magnetic field lift form the piston like rod 24 is moved up or down to increase or decrease support by unlike magnetic poles attracting and like poles repelling so that reversing of polarity and varying of intensity of electro magnetic field affects magnetic push.

Therefore the adjustable support means 21 is selectively able to adjust a portion of the mattress 15 resting on the rotatable planar portion 12*a* out of the plane of extension of the adjacent remainder of the mattress wherein the support base allows for adjustment from a continuous linear formation to a backrest formation with the adjustable support means providing localised support P.

In a particularly preferred form the operation of the rotating planar portion 12*a* by electric motor or magnetic field lift simultaneously operates the adjustable support means 21.

As shown in FIGS. 2 to 5 there are mechanical apparatuses providing the adjustable support means 21. Further in FIG. 2 the support base for a bed mattress includes a differential displacement member 35 connected to the at least one rotatable planar portion 12*a*. The differential displacement member 35 in this case is a curved C-shaped cam with the bottom of the C shape connected to the extension of the rotating planar portion 12*a* on a lower side of the pivot point 13*a*. The top part of the C-shaped cam 35 extends around the pivot 13*a* and has a head part that protrudes into the rear of the mattress about the lumbar position of an occupant of the bed sitting with back resting against inclined rotating planar portion 12*a*. A fixed means in the form of a fixed pin 36 extending outwardly from a supporting plate mounted on the adjacent fixed planar portion 12*b* forms a fixed support along which the outer surface of the C-shaped cam engages. As the rotatable planar portion 12*a* rotates into an upright position the C-shaped cam moves and leans back onto the fixed pin support so that it displaces the head part of the adjustable support means towards the a portion of the mattress resting on the rotatable planar portion such that rotation of the at least one planar portion relative to said another causes adjustment of the portion of the mattress out of the plane of extension of the adjacent remainder of the mattress.

Figure 3:
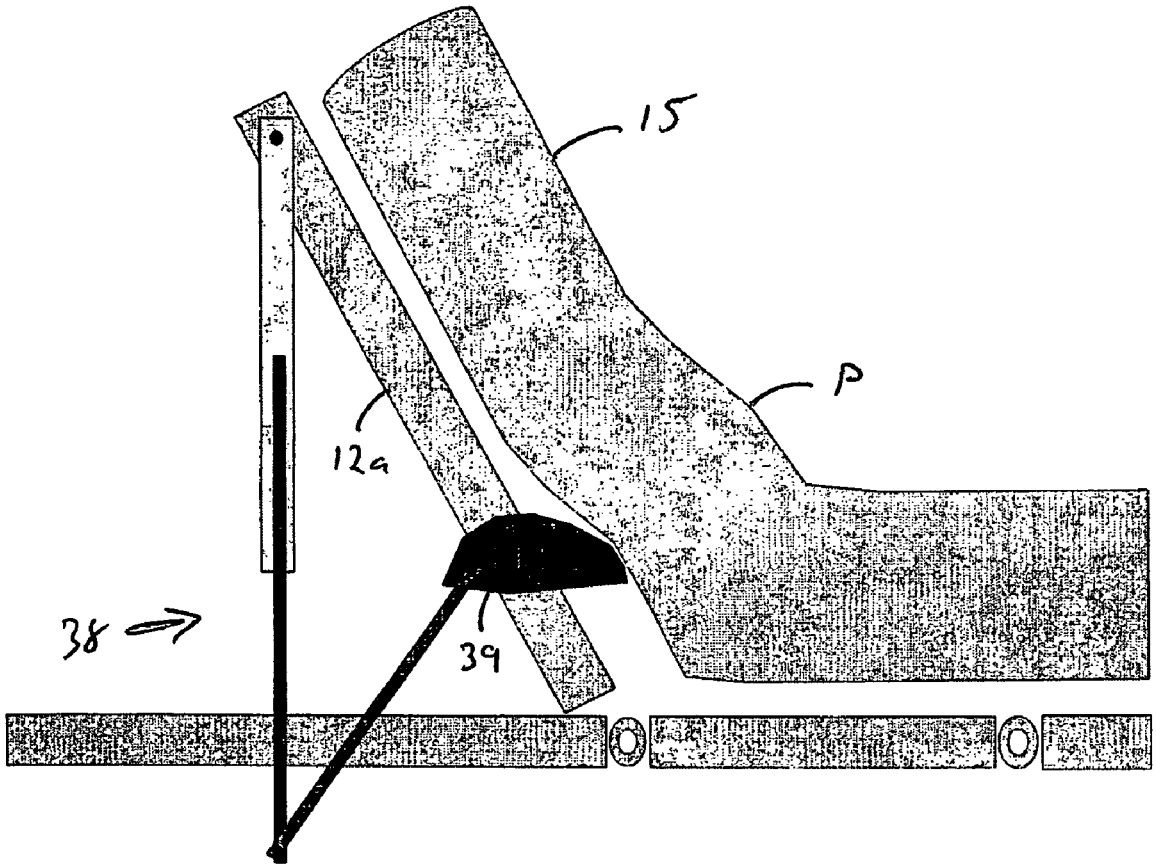
FIG. 3 is a diagrammatic cross sectional view of a support base for a bed and mattress in accordance with a third embodiment of the invention.

Referring to FIG. 3 there is shown a rotating cam as the adjustable support means that extends towards the a portion of the mattress resting on the rotatable planar portion such that rotation of the at least one planar portion relative to said another causes adjustment of the portion of the mattress out of the plane of extension of the adjacent remainder of the mattress. A differential displacement member 38 being an elongated member having central elongated slit fixedly mounted at one end on a top end of the rotating planar portion 12*a* and slidingly mounted on pin mounted on adjacent planar portion 12*b* and sliding within the slit. A further arm 40 extends from a bottom end of the differential displacement member 38 distal from the fixed connection to the rotating planar portion 12*a*. The other end of the further arm is mounted offset on a D shaped cam 39 mounted rotatably on the rotating planar portion 12*a* between the connection of the further arm to the rotating planar portion 12*a* and the pivot 13*a* of the planar portion. In this way rotation of the rotating planar portion 12*a* around the pivot 13*a* causes rotation of the D shaped cam which causes adjustment of the portion of the mattress out of the plane of extension of the adjacent remainder of the mattress.

Figure 4:
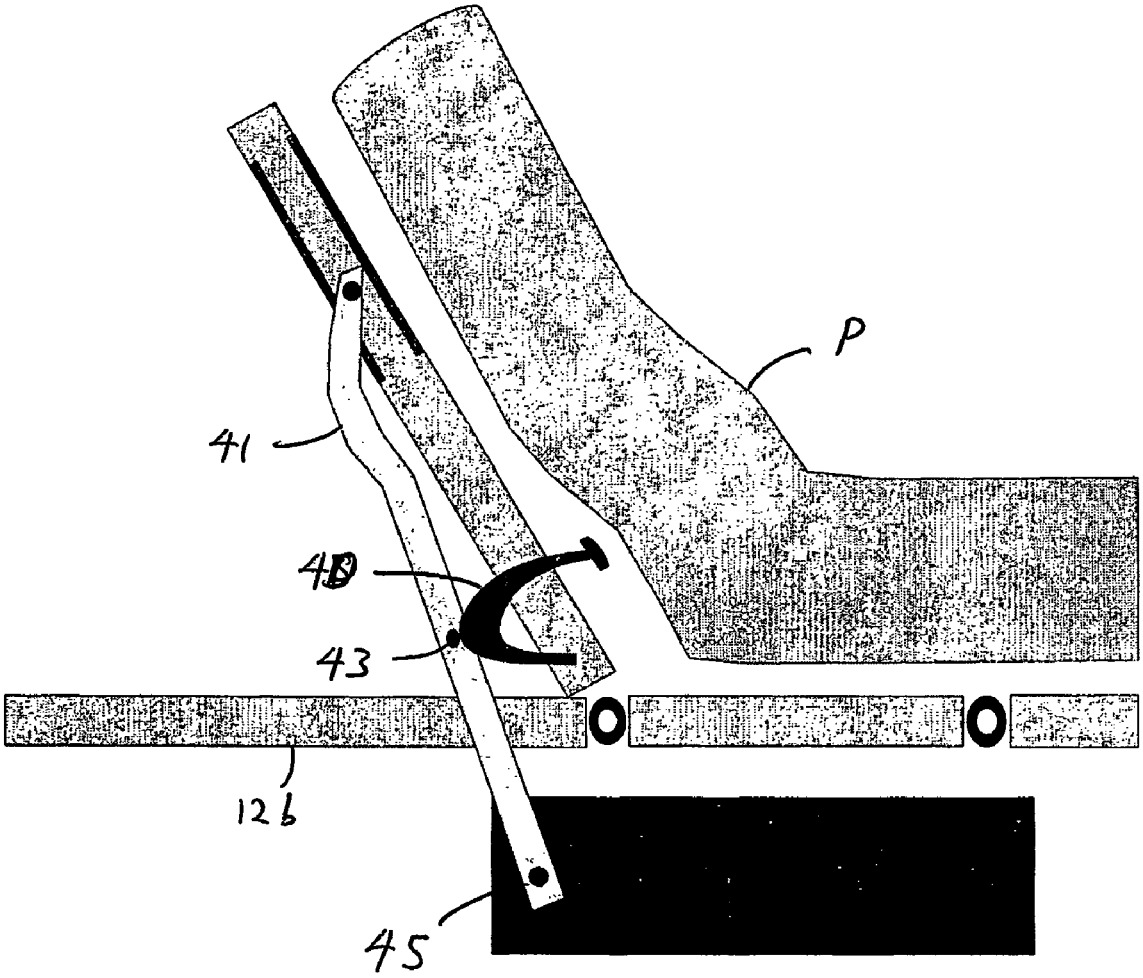
FIG. 4 is a diagrammatic cross sectional view of a support base for a bed and mattress in accordance with a fourth embodiment of the invention in a first operative position.
Figure 5:
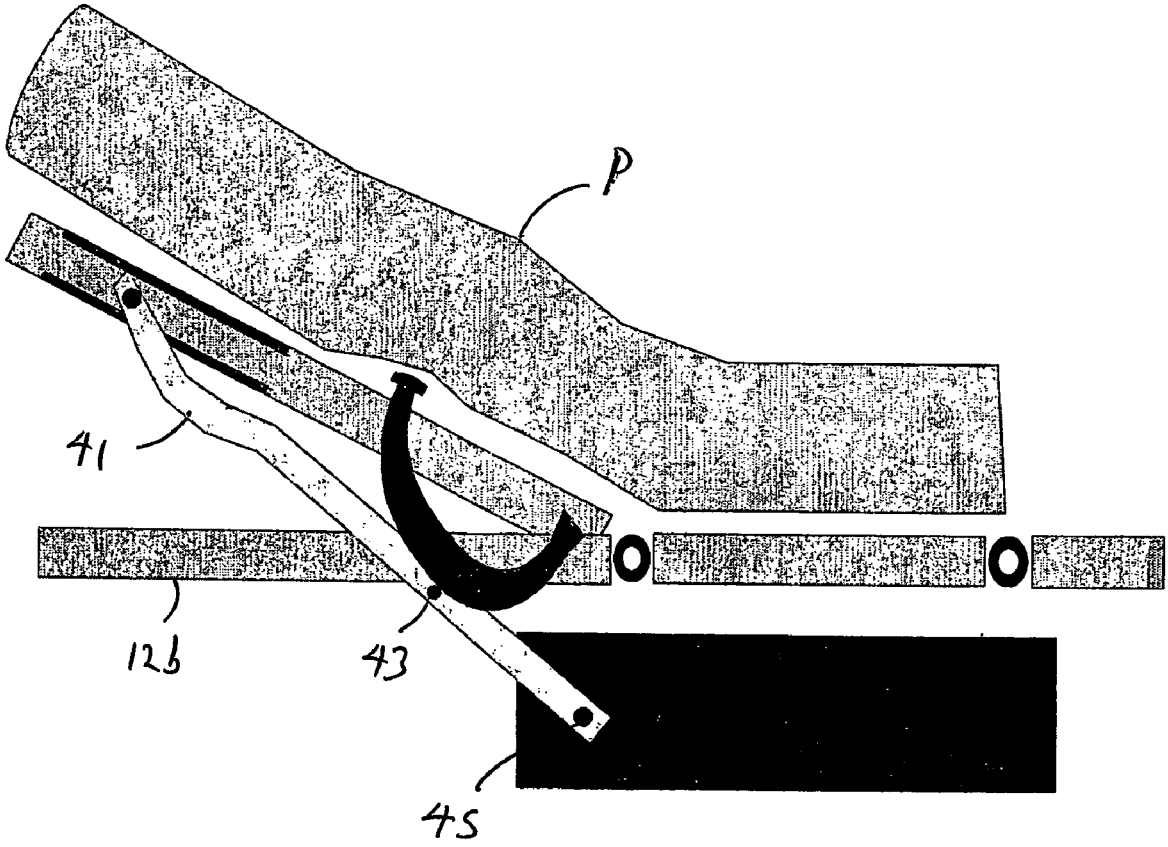
FIG. 5 is a diagrammatic cross sectional view of the support base for a bed and mattress of FIG. 4 in a second operative position.

FIGS. 4 and 5 show a C-shaped cam 40 with the added feature of a differential displacement member being an elongated member 41 connected to the rotatable planar portion 12*a* and engaging a fixed means 45. The elongated member 41 is mounted in a sliding manner in a top end of the rotating planar portion 12*a* and at a lower end at a fixed point 45 below the support base 12*b*. A protruding pin 43 extends outwardly at a position therebetween. The C-shaped cam 40 has a lower end rotatably mounted on the rotating planar portion 12*a* above the pivot 13*a* and has the outer surface engaging the intermediate protruding pin 43 of the differential displacement member which extends at a differing angle to the rotating planar portion 12*a* such that rotation of the rotating planar portion causes a differential movement of the differential displacement member to the rotating planar portion to displace the adjustable support means being the C-shaped cam 40 towards a portion of the mattress resting on the rotatable planar portion such that rotation of the at least one planar portion relative to another causes adjustment of the portion P of the mattress out of the plane of extension of the adjacent remainder of the mattress. The fixed point connection 45 of the differential displacement member can be an electric motor so that it can drive the differential difference and provide the localized displacement.

Figure 6:
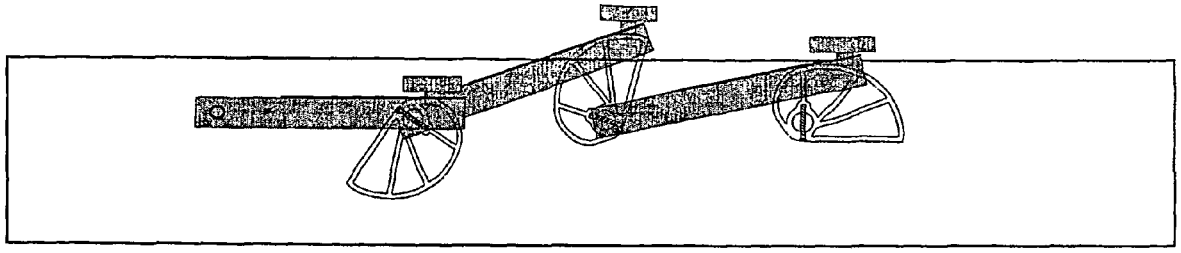
FIG. 6 diagrammatic cross sectional view of a support base for a slat bed in accordance with another embodiment of the invention.

In FIG. 6 there is shown a means of directly supporting slats by interlinked hingedly arranged pivot arms that can be adjusted by D shaped cams. However hinged systems might also be independently hingedly mounted.

It can therefore be seen that the invention allows a design of any amount of variations of structure with required localised support by the mechanical operation of the adjustable support means in conjunction with the folding bed using combination of levers, rods, plates, gussets and sliding mechanisms associated with the hinged folding of the bed to provide adjusting a portion of the mattress out of the plane of extension of the adjacent remainder of the mattress.

Figure 7:
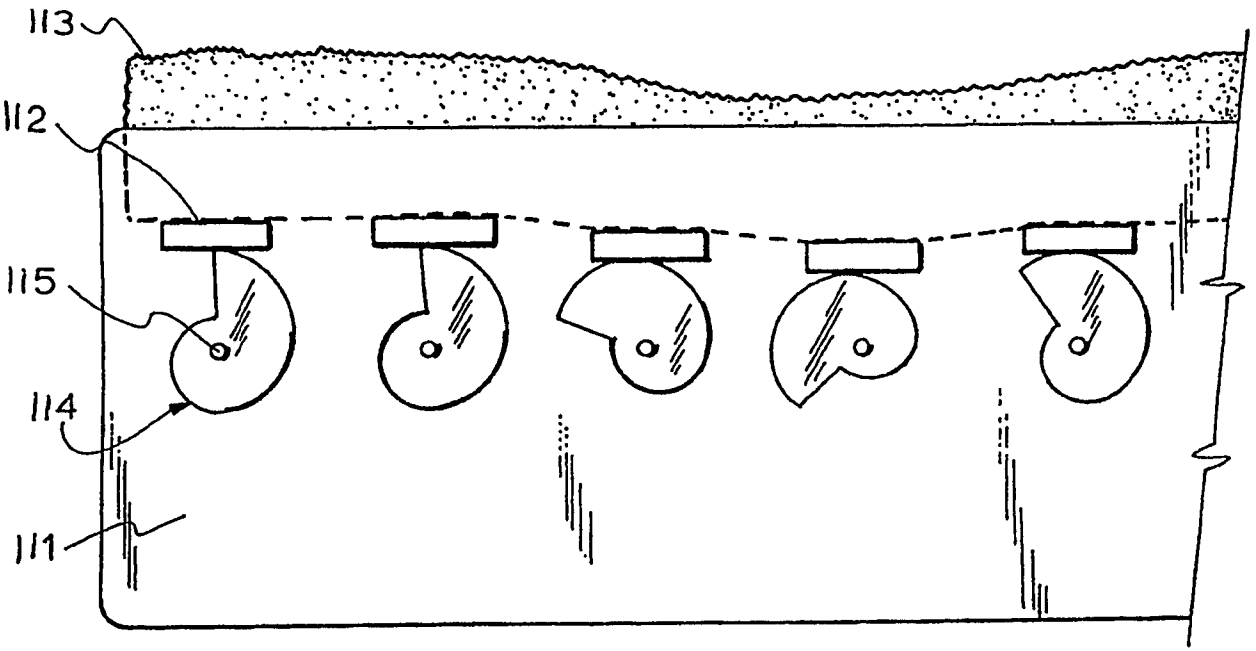
FIG. 7 shows a partial side view of the support base.

Referring to FIG. 7 there is shown a partial side view of the mattress support of an embodiment of the invention. The mattress support is in the form of a support base adapted for supporting a bed mattress over the substantial underneath region of the mattress. The housing will generally take the form of a rectangular or square unit substantially shaped to correspond to the relevant sized mattress including single, double, queen, king etc. The mattress is supported on the top region of the housing by way of a plurality of transverse supporting slats 112 which are positioned within the housing 111 so as to provide the support for the mattress 113. The slats 112 are individually adjustable so as to provide varying heights relative to the housing 111. Each slat is provided with an adjustable cam 114 at either end rotating about an axle 115. The cam 114 cooperates with the supporting slats 112 such that by rotation around the axle 115 allows for the movement of the slat up or down so as to provide the required height for the individual slat.

Figure 8:
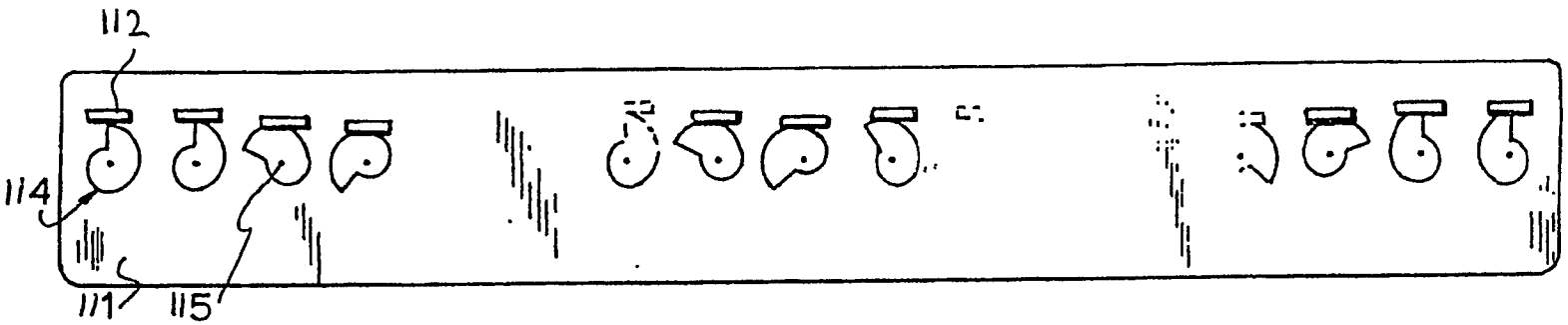
FIG. 8 shows a full side view of the support base without mattress fitted.

FIG. 8 shows a side view of the support base of the invention where the housing 111 accommodates a plurality of slats 112 along the length of the housing for full and total support of the mattress (not shown). The cams 114 are operable by rotating the axle 115 which can be accessed from the exterior of the housing by way of either protruding handles which can be rotated or alternatively the axles can be accessed with an appropriate tool.

FIG. 8*a* shows the support base where the slats have been lowered in region 10 by activation of said cams, to accommodate the hip or shoulder region of the user. If using calibrated height adjustment blocks, this setting would correspond to a cam reading of −2 (−3 from the support and +1 from the block). In region 11 the cams have been raised to accommodate the waist or neck region of the user corresponding to a cam reading of +2 and +1 for the slats shown.

The calibrated cam is shown in FIG. 8*b* where rotation of the cam by a given amount will provide a measure of height adjustment. The cam has calibrations corresponding to linear amounts of lift or drop; for example 5 mm per increment. This calibrated adjustment allows the user to make adjustments in an informed and methodical manner. Moreover, the adjustment up or down by way of the cams can be faithfully replicated in other beds by using blocks 110 which correspond to the movements of the cam in other bases. In this manner, the base of the invention, incorporating the cams, can be used by a medical practitioner to measure the patient and determine the adjustments needed and the patient can be supplied with the corresponding array of lifting blocks for installation in their home bed. In this way the more complex cam unit can be used by a selection of practitioners to benefit patients in need of dedicated bed support.

That is, while a practitioner may have need of an easily adjustable bed such as is provided by the use of cams, a patient, once diagnosed, may not require a variable height bed implemented by cams, but may simply require a variable height bed implemented by blocks, the blocks being set to heights determined by the practitioner using a cam adjustable bed.

Figure 9:
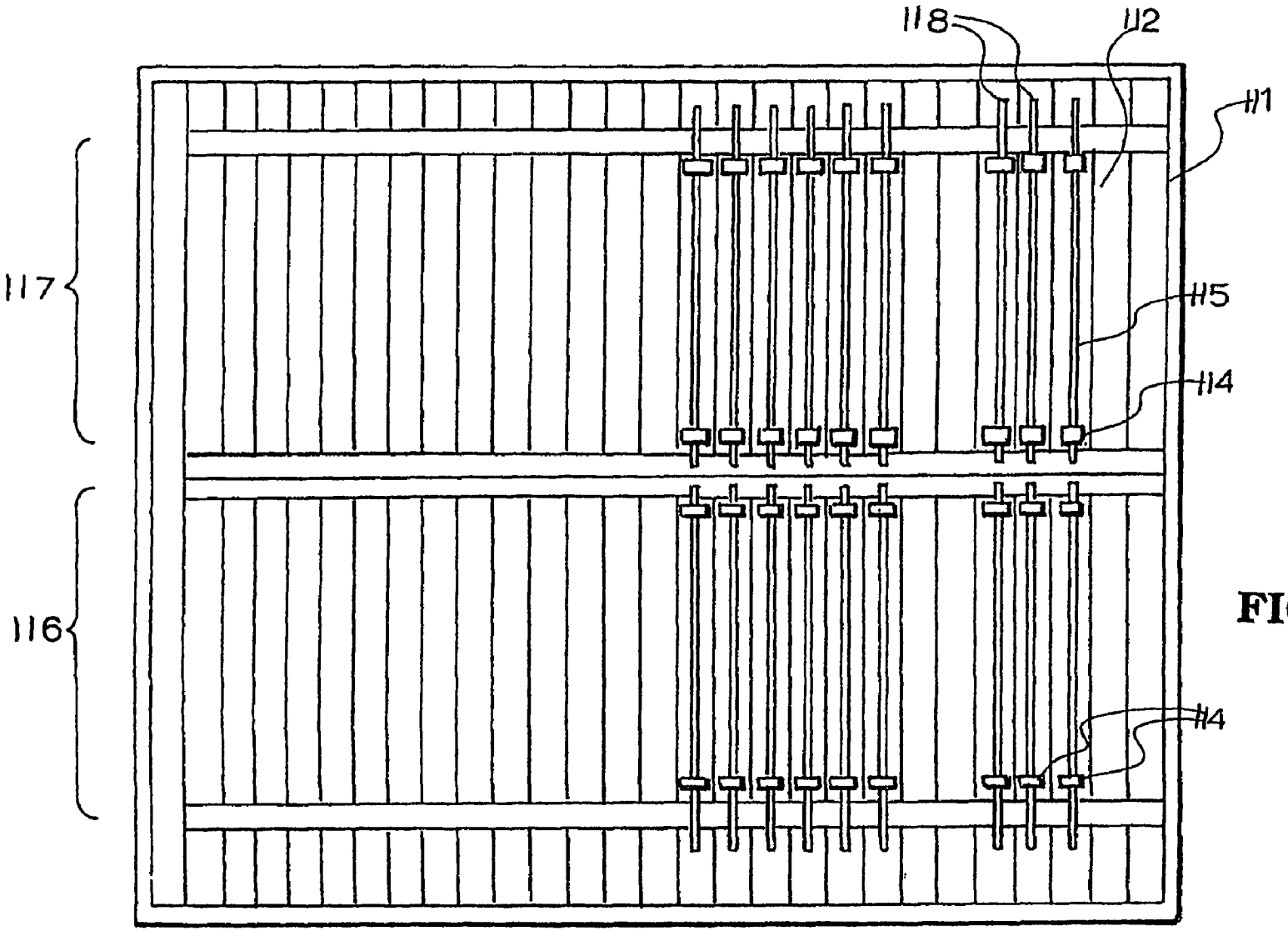
FIG. 9 shows a plan view of the support base featuring cam adjustment.

Referring now to FIG. 9 a plan view of the invention is shown where the support base has a rectangular housing 111 and a plurality of slats 112 running transversely across the base over the whole length of the housing.

The particular embodiment shown in FIG. 9 has slats provided for each side of the base which are individually adjustable from side to side and along the length thereof. Such individual adjustment allows complete tuning of the macro support for each side of a mattress placed on top thereof.

Each slat has a cam 119 positioned at either end connected and operated via an axle 115. The slats may be divided into two separate sides 116 and 117 to provide for independent adjustment for each user. The slats have a cam 114 at either end to provide the variable height support which can be adjusted by rotating the axle 115 which protrudes to the exterior of the housing 111. The external protrusions 118 allow ready adjustment of the height of the individual slats.

Figure 10:
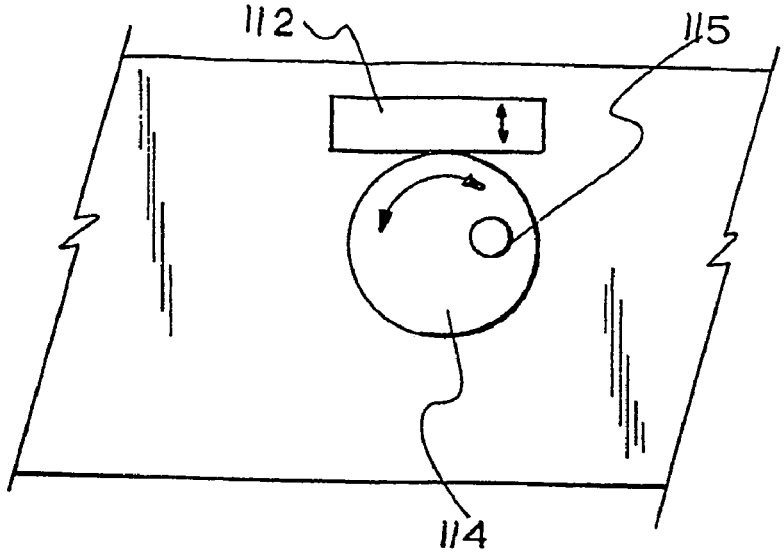
FIG. 10 shows the end view of an eccentrically mounted elongate cam.
Figure 11:
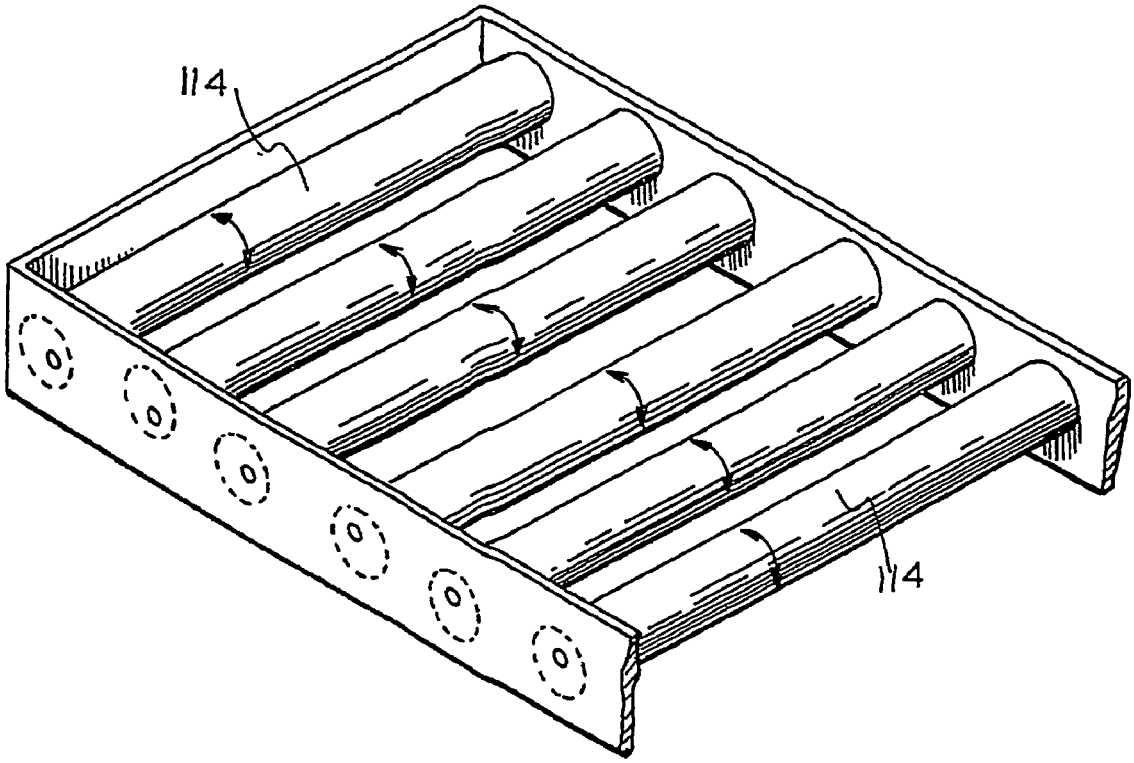
FIG. 11 shows a perspective view of a support base incorporating a plurality of elongate cams.

Referring now to FIGS. 10 and 11 an alternative embodiment of the invention is shown where the supporting slats 112 are individually adjustable and supported by an elongate cam 114 which can be eccentrically pivoted about the axle 115. Such elongate cams provide a simplified operating mechanism and ensure uniform adjustment of each slat along its length.

An extension of the previously detailed aspect of the invention may be provided as shown in FIG. 11 where the elongate adjustable cams 114 provide support for the mattress directly without the need for riding slats. Such an embodiment will depend on suitably dimensioned cams 114 or alternatively a sufficient number of cams closely placed together so as to provide adequate point support for said mattress.

Figure 12:
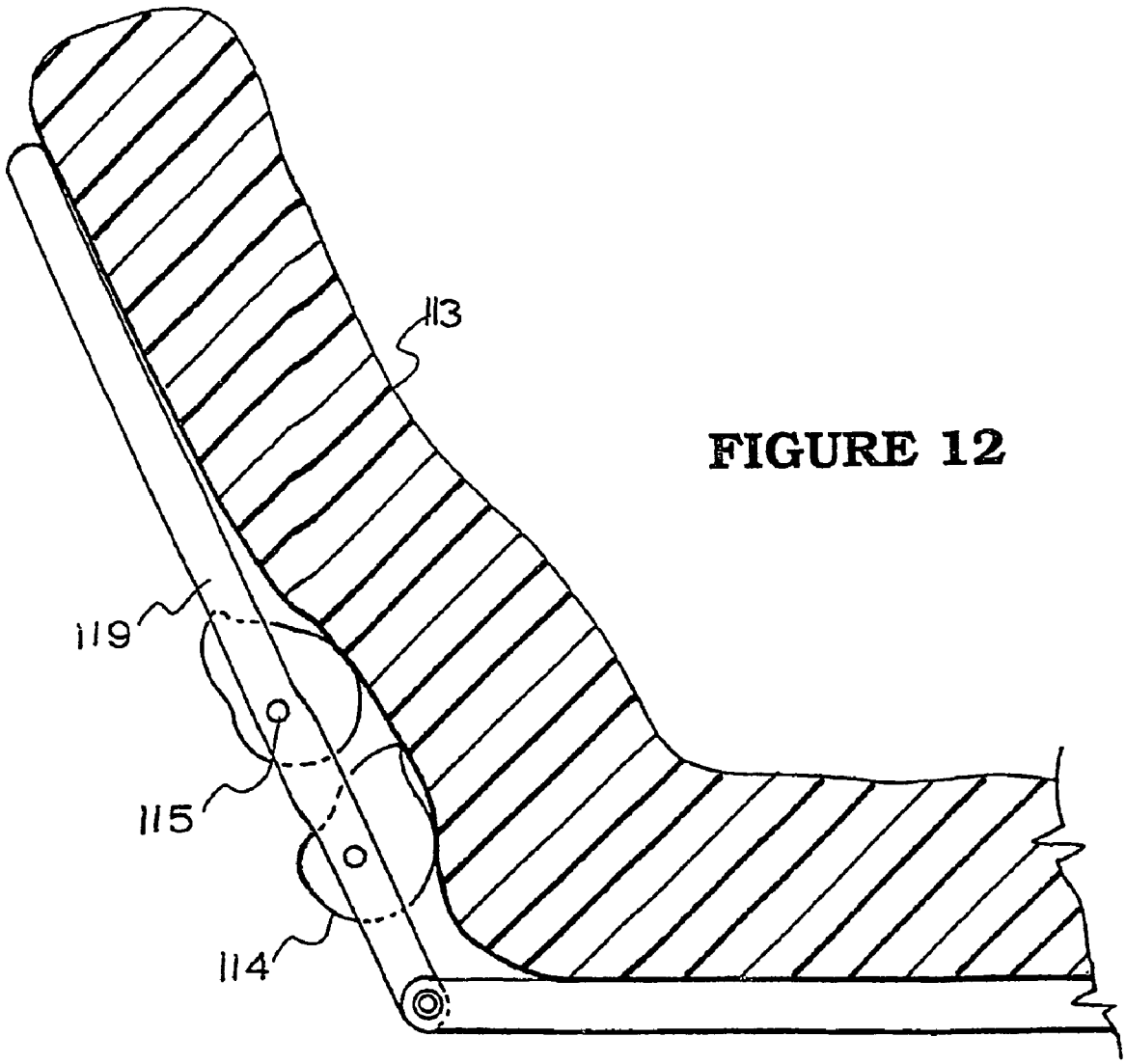
FIG. 12 shows a hospital or invalid bed incorporating the variable support features in the lumbar region.

FIG. 12 details another embodiment of the invention where the support base is in the form of a folding unit having a section pivotal for raising so as to support the user in a partially elevated position. Such a support base would be particularly suitable for hospital or invalid applications where the user requires elevation in a variety of positions. Such currently available units however suffer from the inability to provide adequate lumbar support and the invention provides features allowing such deficiencies to be directly and efficiently addressed. The raiseable portion of the mattress support 119 may be provided with one or more cams 114 which can be either elongate and/or cooperate with a slat. In the example where the cams are elongate, and function without a slat, they may be used in place of slats over that given region and operate to push the mattress 113 in or out in accordance with the user's requirements. The elongate cams 114 may be shaped to function as a cam or alternatively, may be in the form of cylinders with eccentrically mounted axles 115. In this manner, the features of the invention can be applied over a limited area of a support base to provide specific adjustment features to a particular region which can be adjusted readily and in accordance with the user's requirements.

The support base of the invention provides for the first time, a fully adjustable and variable macro support for a bed mattress. In particular, embodiments of the invention utilising cams may provide the ability to adjust and tailor the heights of individual slats of the support base whilst the mattress is in situ and indeed the slats can be adjusted whilst the occupant is lying on the fully configured bed.

The slats can be either totally independent in their adjustment or if desirable some slats could be interconnected to speed up and/or coordinate the adjustment regime of a given bed.

In use the support base of the invention would be used in conjunction with a suitable mattress and the profile of the user would allow either a professional orthopaedic adviser or an informed user to adjust the macro support for the mattress so as to provide the necessary differentiation required over the length of the mattress in order to properly and correctly provide the necessary orthopaedic support for each individual user. The ease and confidence with which the support base of the invention can be adjusted allows the user to make various adjustments if and when required, and the infinite adjustment available by way of the operating cams and fine adjustment available by way of height adjustment blocks allow complete variation as would be required by any user. The adjusting handles could be provided with optional reference readings and calibration to allow quantitative adjustment of the macro support for a mattress so as to assist the user or practitioner to obtain the ideal support required. Such quantitative adjustment facilities of the support base of the current invention would also allow professional advisers to conduct assessments of individual patients and provide recommendations for the patient to make adjustments to the support base in accordance with their medical requirements without the need for attending the user's bedside.

As can be seen the adjustable bed system allows a selection of constructions of base to allow adjustable bed construction that suits the user. This is further extended by selection of spring systems and padding systems. The present invention relates to bed and mattress structures and particularly to mattress structures that can be customised to individual users. The mattress of the present invention can be delivered to the user in a variety of forms assembled from kits provided at the point of sale to accommodate the musculoskeletal condition of the user. The mattress can also be customised at the factory or at some assembly location or at the point of sale based on a customer's requirements.

The mattress includes the separate components of springs and padding. The mattress further includes one or more mattress covers which preferably combine one user's selection of springs and padding. A second user's selection can be incorporated in a separate mattress cover. For double or queen or king sized beds the two user's selected combination can then be retained together to form a single bed by means of a further mattress cover or by the continuous base. Alternatively a single double or queen or king sized mattress cover could house the two user's separately selected combination of springs and padding.

The mattress covers define a mattress interior receiving a plurality of mattress structure components. The bottom cover can be placed on a surface and used as a template for building the mattress with a "bottom up" assembly technique placing the components on the bottom of the mattress on top of the bottom cover and building the other components thereon. The top cover may also be positioned to facilitate a "top down" assembly by starting with the top cover and first adding the components on the top of the mattress to the top cover and building the other components thereon.

The mattress structure components include a frame made from a relatively firm foam rubber such as a high resiliency, high density urethane foam. The frame is positioned generally along the perimeter of the mattress. Use of a relatively firm foam provides support characteristics that aid users as they ingress and egress to and from an upwardly-facing sleeping surface of the mattress and that prevent the user from rolling off of the sleeping surface.

A plurality of cores including an air bladder, "zone foam" elements, "sculptured foam" shaped from foam blocks, and combinations thereof are provided for filling the central opening. The cores are selected to customize the firmness, support, and interface pressure characteristics to meet the individual desires of each user. To customize the mattress in such a fashion requires considering the combination of each individual's height, weight, body type, weight distribution, health conditions, and preferences.

The preferred method for customising the mattress is initiated when a potential user completes a questionnaire to aid in the analysis of that user's "sleep profile." The sleep profile assesses such factors as the user's general health and sleep habits. A firmness recommendation is computed either in terms of a pressure for various zones of a "test mattress" containing an air bladder or in terms of a foam type and density for each zone. In addition, a surface recommendation is established based on the user's responses to a surface recommendation questionnaire.

Once the surface and hardness recommendations are established, the user lies on a test sleeping surface. The preferred firmness readings can be translated to establish the foam density that, if incorporated into a mattress, will provide the firmness and support characteristics similar to those provided by the test sleeping surface having the preferred firmness readings.

Once the customized bed configuration is established, a mattress can be assembled from a kit at the point of sale containing the plurality of cores for the user to test and verify that the mattress meets his or her preferences. If the mattress is not satisfactory, it can be adjusted at the point of sale. Once the user is satisfied, he or she can immediately take delivery of the completed customized mattress if desired.

The mattress structure in accordance with the present invention can be sized for a twin bed, a double bed, a queen-sized bed, or a king-sized bed. When the mattress is sized for queen-sized and king-sized beds, both sides of the mattress can be individually customised if desired to provide the firmness and support characteristics desired by individual sleep partners by customising the core and customising the top to provide the desired firmness and support for each side of the bed.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive

The invention claimed is:

1. A support base for a bed mattress comprising:

at least two planar portions with at least one rotatable planar portion able to rotate relative to an adjacent planar portion with a planar flexible continuous mattress able to extend over both the rotatable planar portion and the adjacent planar portion;

an adjustable support means at least partially mounted on the rotatable planar portion and selectively able to adjust a portion of the mattress resting on the rotatable planar portion out of a plane of extension of the adjacent remainder of the mattress wherein the support base allows for adjustment from a continuous linear formation to a backrest formation with the adjustable support means providing localized support; and a differential displacement member connected to the at least one rotatable planar portion, said differential displacement member engaging said adjustable support means so as to displace the adjustable support means towards a portion of the mattress resting on the rotatable planar portion such that rotation of the at least one planar portion relative to said another causes adjustment of said portion of the mattress out of the plane of extension of the adjacent remainder of the mattress.

2. A support base for a bed mattress according to claim 1 wherein the adjustable support means is able to selectively adjust a portion less than a quarter of the mattress.

3. A support base for a bed mattress according to claim 1 wherein the adjustable support means is positioned to adjust an end portion of the mattress to provide a headrest or footrest for a user of the bed.

4. A support base for a bed mattress according to claim 1 wherein the adjustable support means is positioned to adjust a middle portion of the mattress to provide a lower lumbar support or knee support for a user of the bed.

5. A support base for a bed mattress according to claim 1 including a housing having a plurality of transverse slats for supporting said mattress wherein one or more of said slats are individually adjustable relative to said housing to provide calibrated positive or negative height adjustment for each slat, characterized in that said height adjustment is provided by a means which is operable external to said housing.

6. A support base according to claim 5 wherein said means for providing said height adjustment are cams fitted to said housing for rotational movement and cooperation with said slats to impart a vertical height adjustment to said slats.

7. A support base according to claim 6 wherein said cams are operated in pairs with one cam positioned at or near each end of said slats and wherein said cam pairs are operated simultaneously.

8. A support base according to claim 5 wherein said calibration indicates the height of said slats relative to said housing.

9. A support base according to claim 6 wherein said cam pairs are fitted to a common axle which can be accessed from outside said housing.

10. A support base according to claim 6 wherein said cams extend the length of each individual slat.

11. A support base according to claim 1 wherein the adjustable support means and the differential displacement member are a C-shaped cam.

* * * * *